US006391158B1

(12) United States Patent
Metzler et al.

(10) Patent No.: US 6,391,158 B1
(45) Date of Patent: May 21, 2002

(54) METHOD FOR LOOSE DRAW DETECTION IN A PAPER MACHINE WET PRESS

(75) Inventors: Steven Paul Metzler; Todd Arik Ninnemann; Roberta Lee Offenbacker, all of Covington, VA (US)

(73) Assignee: Westvaco Corporation, Stamford, CT (US)

( * ) Notice: Subject to any disclaimer, the term of this patent is extended or adjusted under 35 U.S.C. 154(b) by 5 days.

(21) Appl. No.: 09/607,981

(22) Filed: Jun. 30, 2000

(51) Int. Cl.[7] ..... D21F 11/00; G01N 21/86

(52) U.S. Cl. ..... 162/198; 162/DIG. 10; 162/DIG. 11; 700/127; 356/429; 356/400; 356/237.1; 356/239.7; 250/492.1

(58) Field of Search ..... 162/198, DIG. 10, 162/DIG. 11, 252, 253, 255, 262, 263; 700/127–129; 356/429–431, 238, 446, 237.1, 239.7, 399–400; 250/492.1, 492.23

(56) References Cited

U.S. PATENT DOCUMENTS

| | | | | |
|---|---|---|---|---|
| 4,500,968 A | | 2/1985 | Bialkowski | |
| 4,680,873 A | | 7/1987 | Fellers et al. | |
| 4,902,384 A | | 2/1990 | Anstötz et al. | |
| 5,002,638 A | | 3/1991 | Gulya et al. | |
| 5,094,718 A | | 3/1992 | Friend | |
| 5,159,893 A | | 11/1992 | Rantanen | |
| 5,240,564 A | | 8/1993 | Niskanen et al. | |
| 5,298,121 A | | 3/1994 | Kilmister | |
| 5,314,581 A | | 5/1994 | Lin et al. | |
| 5,349,845 A | | 9/1994 | Blom | |
| 5,379,526 A | | 1/1995 | Haverinen | |
| 5,403,447 A | | 4/1995 | Järvinen et al. | |
| 5,472,571 A | * | 12/1995 | Niemi | 162/198 |
| 5,501,775 A | | 3/1996 | Kotitschke et al. | |
| 5,745,244 A | * | 4/1998 | Svanqvist et al. | 356/429 |
| 5,776,309 A | * | 7/1998 | Fraik | 162/198 |
| 6,074,531 A | * | 6/2000 | Hultcrantz et al. | 162/263 |
| 6,219,141 B1 | * | 4/2001 | Perrault | 356/429 |
| 6,231,722 B1 | * | 5/2001 | Vestola | 162/198 |
| 6,261,415 B1 | * | 7/2001 | Johansson et al. | 162/193 |

* cited by examiner

*Primary Examiner*—Jose Fortuna
(74) *Attorney, Agent, or Firm*—D. L. Bowman; T. B. McDaniel; R. L. Schmalz

(57) ABSTRACT

This invention relates to a loose draw detector for a paper machine wet press. Such structure of this type, generally, use laser triangulation displacement sensors mounted and positioned to measure the point of web release from the center roll and measure paper web wrinkles in the form of rapid fluctuations/decreases in the standoff distance between sensors and the web passing over the leadout roll to determine loose draw.

5 Claims, 1 Drawing Sheet

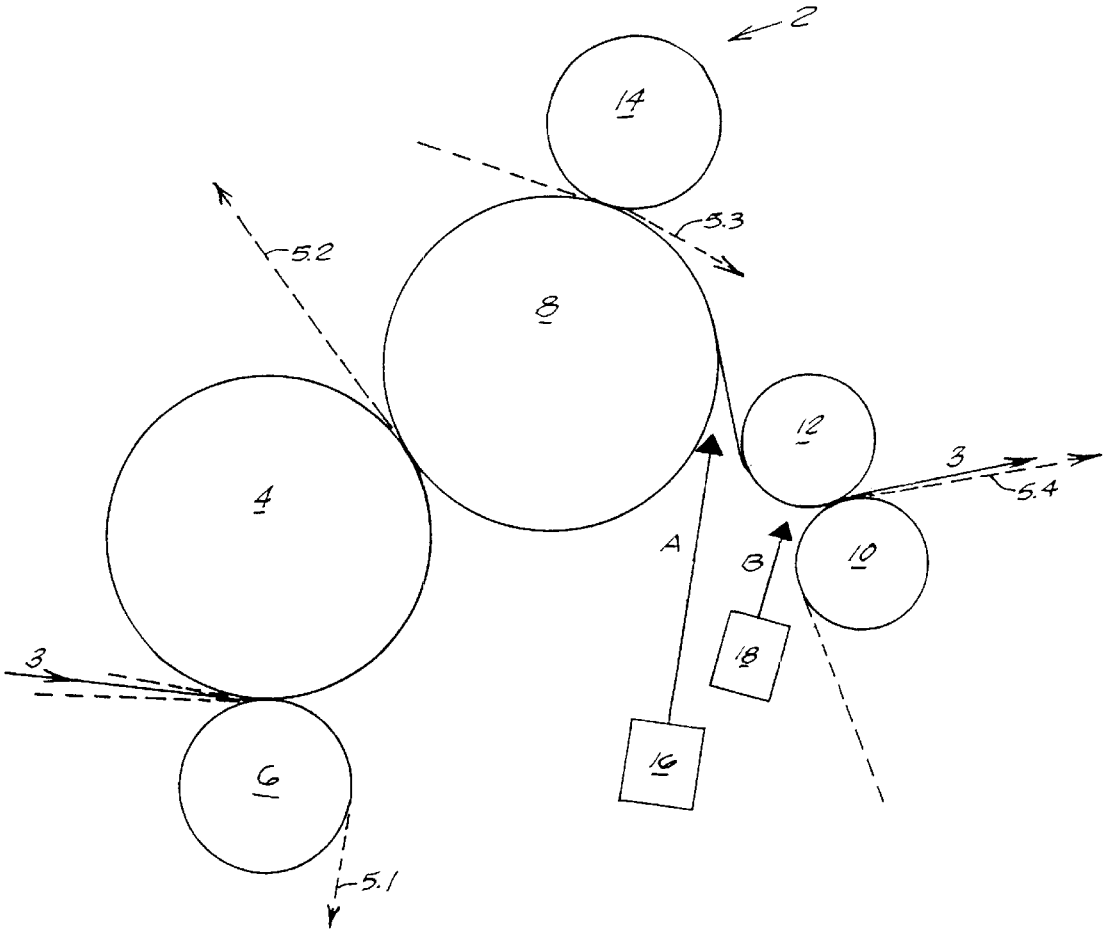
FIGURE

METHOD FOR LOOSE DRAW DETECTION IN A PAPER MACHINE WET PRESS

BACKGROUND OF THE INVENTION

1. Field of the Invention

This invention relates to a loose draw detector for a paper machine wet press. Such structure of this type, generally, use laser triangulation displacement sensors mounted and positioned to measure the point of web release from the center roll and measure paper web wrinkles in the form of rapid fluctuations/decreases in the standoff distance between sensors and the web passing over the leadout roll to determine loose draw.

2. Description of the Related Art

The tension of a dry paper web can be conventionally measured via several approaches, but the press section of the web is still wet (water content by weight is at least 50%) and has very little tensile strength, in that any direct measurement of tension would compromise web transfer. Some paper machines have an "open draw" between rolls where the unsupported sheet run is horizontally oriented. In this situation, machine drive speeds can be regulated to maintain the web vertical location at a desired point.

It is known to attempt to reduce the incidence of draw-related web breaks at the press section of the paper machine. Exemplary of such prior art is U.S. Pat. No. 5,002,638 ('638) to T. G. Gulya et al., entitled "Papermaking Machine in Which the Paper Web is Supported in the Draw Between the Press and Dryer Sections." The '638 reference employs a press configuration that eliminates an "open draw" between the last press nip and subsequent steam drying section, in that the press felt is made to wrap the first dryer can so that the felt conveys the sheet into the dryer section.

It is also know to employ a device which is intended to reduce web flutter without making adjustment to machine drive speed. Exemplary of such prior art is U.S. Pat. No. 5,094,718 ('718) to W. H. Friend, entitled "Method and Apparatus for Control of Web Flutter." The '718 measures acoustic disturbances set up when the web flutter is present, then actively modulates/reduces the amount of flutter. The latter is accomplished by broadcasting a second acoustic disturbance, whose phase is shifted approximately 180 degrees from that of the measured disturbance, so that the two cancel each other. However, a more advantageous device would be one which employs a means to keep control to a minimum level the amount of web draw at the first point in a paper machine where the web is unsupported, namely between two successive press nips.

It is apparent from the above that there exists a need in the art for a loose draw detector for a paper machine wet press which measures the point of web release from the center roll and measure wrinkles in the form of rapid fluctuations/decreases in the standoff distance between the sensor and the web passing over leadout roll. It is the purpose of this invention to fulfill this and other needs in the art in a manner more apparent to the skilled artisan once given the following disclosure.

SUMMARY OF THE INVENTION

Generally speaking, this invention fulfills these needs by providing a paper web loose draw detection system for a paper machine wet press, comprising a paper machine wet press section including a center roll and a paper leadout roll located substantially adjacent to the center roll, a paper web which is traversed through the wet press section such that the web contacts the center roll then the leadout roll, and a first loose draw detector means located substantially between the center roll and the leadout roll and a second loose draw detector means located substantially adjacent to the leadout roll, such that a loose draw in the web is substantially detected by the first and second detection means by measuring a position of the web through a beam of light from the first and second detection means, wherein the beam of light from the first detector means is substantially tangent to the center roll so as to substantially coincide with a region in which the web separates from the center roll and wherein the beam of light from the second detector means is substantially perpendicular to the web as the web passes over the paper leadout roll.

In certain preferred embodiments, the first and second detection means are laser triangulation sensors.

In another further preferred embodiment, since the problem at hand, namely the source of web breaks, is a difficulty of web release from the press roll, this loose draw detector configuration effectively monitors the variable of concern for draw-related breaks in a press section.

The preferred detector, according to this invention, offers the following advantages: lightness in weight; good stability; excellent durability; loose draw detection; ease of measurement of web release; ease of measurement of wrinkles; and good economy. In fact, in many of the preferred embodiments, these factors of durability, loose draw detection, measurement of web release, and measurement of wrinkles are optimized to the extent that is considerably higher than heretofore achieved in prior, known detectors.

The above and other features of the present invention, which will become more apparent as the description proceeds, are best understood by considering the following detailed description in conjunction with the accompany FIGURE, wherein:

BRIEF DESCRIPTION OF THE DRAWING

The FIG. is a schematic illustration of a loose draw detection system, according to the present invention.

DETAILED DESCRIPTION OF THE INVENTION

With reference first to the FIGURE, there is illustrated an advantageous environment for use of the concepts of the present invention. In particular, loose draw detection system 2 is illustrated. System 2 includes in part, paper web 3, conventional suction press roll 4, conventional press felts 5.1, 5.2, 5.3, and 5.4, conventional grooved roll 6, conventional center roll 8, conventional felt roll 10, conventional paper leadout roll 12, conventional grooved roll 14, and sensors 16 and 18.

Sensors 16 and 18, preferably, are laser triangulation sensors. More particularly, sensor 16 produces a beam A which is nearly tangent to an area near roll 8, where web 3 separates from roll 8. Also, sensor 18 produces a beam B which is nearly perpendicular to an area of web 3 on roll 12, where web 3 passes over paper leadout roll 12. In this manner, sensor 16 is used to measure a point of web release from center roll 8 and sensor 18 is used to measure wrinkles in the form of rapid fluctuations/decreases in the standoff distance between sensor 18 and web 3 passing over leadout roll 12.

With respect to the operation of system 2, system 2 uses sensors 16 and 18 to measure position of web 3 at two different machine direction (MD) locations. The first location is the open draw immediately following the point of web release from the press center roll 8, the algorithm for the processing of this signal is described in part "B". The second location where web position is monitored is at the paper leadout roll 12, sensor 18 examines how the web wraps the leadout roll 12, and the algorithm for the processing of these signals is described in part "A". The break warning system is implemented such that all displacement signals will are passed to a conventional computer via a conventional A/D unit.

A. Web Wrinkle Detection at Leadout Roll

One symptom of a loose draw is when small wrinkles or ripples form in web 3 as it passes over the paper leadout roll 12. Displacement transducer or sensor 18 mounted beneath the paper leadout roll 12 sees wrinkles as rapid fluctuations/decreases in the standoff distance between sensor 18 and the web 3 on the roll 12. In general, the software routine continuously updates a moving or transient "boxcar" average of each displacement signal, then compares instantaneous values to the average within the present time internal, to detect a loose draw condition. It is to be understood that ultimately three laser displacement transducers may be used, each having an analog output signal that represents web-to-senser standoff distance at three different locations transversely disposed across the width of the paper machine. The program has three "channels", but will function if there are only one or two live signals. Each channel has a calculation routine that runs independently of the others.

The following variables are adjustable: f, TC, NOISE, N, and NN. These are shared in common by all three "channel algorithms," as explained below.

Sample each transducer or sensor signal at variable rate: f=10–1000 Hz. Time constant is the time over which the boxcar average is formed: TC=1–5 seconds. Then the number of samples within each average=f*TC.

So, the boxcar average (BOXCAR) is the latest updated average standoff distance between sensor 18 and the surface of leadout roll 12. The use of a continuously updated moving average means that system 2 can self-calibrate after being put into measuring position of if sensor 18 is bumped from one position to another, or if signal level changes (due to small amounts of lens contamination or a drift in sensor calibration). Standoff distance will also be reduced by an amount, the caliper of the wet web, when machine is threaded up.

DEV=BOXCAR—latest instantaneous sampled value. If DEV is less than a certain small value (NOISE=an adjustable value) no action is taken. "NOISE level" needs to be set just as soon as system 2 is first mounted on machine, watch and see what is normal peak level of measurement variation, then set; NOISE slightly greater than that value.

DEV=BOXCAR—latest value. If DEV is greater than NOISE, increment a counter called EVENTS. If deviations keep occurring to the point that EVENTS=N*f*TC, sound an alarm. The value "IN" will be settable to a number between 1 and 10. If N were less than one, it would be possible for a step change in the measurement (such as will happen when sensor 18 is repositioned, or when the machine is threaded up) to create an alarm condition. As long as N is greater than one, the boxcar average that results in response to step change will be completely updated (after f*TC samples) before an alarm condition is encountered (at N*f*TC) The larger the value of N, the longer it will be before alarm is sounded. Probably N~1.5 will strike the balance between response time/sensitivity and conservatism/no false alarms.

When an actual loose draw condition is encountered, the value for BOXCAR will decrease slightly due to the sheet rippling over leadout roll 12, but the amplitude of the ripples exceeds the value for NOISE so that EVENTS is incremented. With a loose draw, EVENTS will accumulate quickly. However, to avoid EVENTS slowly accumulating from spurious events to an alarm level over time, one would want to reset to zero after a certain time period. So, when the EVENTS count is started (when EVENTS=1), also start a timer from zero. If EVENTS after NN*N*TC seconds has not reached alarm level (N*F*TC), set EVENTS and the timer back to zero. Make NN adjustable between 1 and 20. (If NN is too small, EVENTS will be re-zeroed before alarm is sounded. If NN is set too large, may have occasional false alarms. Start out with NN~10.)

When alarm is sounded, reset EVENTS=O for the channel that alarmed. If no corrective action is taken, the events count will likely reach alarm level again and again, but the active "alarm state" will not switch off until operator acknowledges via, preferably, the PC screen.

In short, system 2 determines an average position of web 3 over leadout roll 12, then system 2 determines that a wrinkle is present if the instantaneous position of web 3 over leadout roll 12 differs from the average position of web 3 over leadout roll 12 by a specific value.

For example, sampling at f=100 Hz and with time constant TC=2 seconds, each boxcar average will consist of 200 samples. If a loose draw occurs, with N=1.5 will sound alarm with EVENTS=300. With NN=10, EVENTS count must reach 300 within 30 seconds after the start of the count, or EVENTS will be reset to zero. This algorithm will run independently for each channel, if a channel has no probe and its signal=0 (or a constant value), no "events" will be seen by that channel. Alarm sounds when EVENTS=N*f*TC=300 for any channel, and stays on until an operator acknowledges.

B. Center Roll Web Release Measurement

Another symptom of a loose draw is when sheet release from the center roll 8 is delayed. A sensor 16 mounted to the tending side machine frame measures tangential position of web 3 as it leaves the center roll 8. A loose draw is measured as a reduced sensor-to-web standoff distance.

Measurement signal is sampled at the same frequency "f" as the signals just described in part A. A stable readout of the tangential position is obtained via a transient boxcar average calculated the same way as in part A, but with a different time constant TC1=1–10 seconds. If the time-average value for tangential position of web 3 ever decreases to a certain low value=LOW, an alarm condition occurs. The same operator alarms and displays appear as in part A, although the program itself will record the individual channel, or sensor 16, from which the alarm originated. As in part A, the alarm condition stays in effect until operator acknowledges.

In short, loose draw is detected by measuring paper web 3 position via a sensor 16 whose beam A is nearly tangent to paper center roll 8. By intentionally making the point "near tangency" coincide with the region in which web 3 separates from roll 8 and roll 12, this sensor configuration supplies indirect measurement of the point of separation. Since the problem at hand, namely the source of web breaks, is the difficulty of web release from roll 8, this sensor configuration effectively monitors the variable of concern with draw-related breaks in a press section.

In order to prove the efficacy of the present invention, a prototype version of a web break warning system 2 was successfully tested, where a major cause of wet end breaks is a loose draw condition between the presses. The level of draw required for web transfer varies in response to changes in furnish composition, refining levels, wet end chemistry, and jet/wire ratio. Operators monitor the draw by observing the location and angle of web 3 release off the press center roll 8, and by watching for ripples in web 3 as it passes over the paper leadout roll 12. The break warning system 2 continuously monitors web 3 position on the leadout roll 12 as high frequency variations in the sensor-to-sheet standoff distance. Capability of this system in prototype form was demonstrated when operators carefully decreased web draw to make sheet wrinkles appear, the system 2 alarmed seconds afterward.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method for detecting a draw of a web is a paper machine wet press section, comprising a paper machine wet press section including a center roll and a paper leadout roll located substantially adjacent to said center roll, a paper web which is traversed through said wet press section such that said web contacts said center roll then said leadout roll, and a first loose draw detector means located substantially between said center roll and said leadout roll and a second loose draw detector means located substantially adjacent to said leadout roll, such that a loose draw in said web is substantially detected by said first and second detection means by measuring a position of said web through a beam of light from said first and second detection means wherein said beam of light from said first detector means is substantially tangent to said web so as to substantially coincide with a region in which said web separates from said center roll, and wherein said beam of light from second detector means is substantially perpendicular to said web as said web passes over said leadout roll, wherein said method is comprised of the steps of:

measuring within a preset time interval a point of release of said web from said center roll by said first detector means;

measuring a number of wrinkles on said web by said second detector means;

comparing said measured point of release and said number of wrinkles; and adjusting said paper machine wet press if a loose draw of said web is detected.

2. The method, as in claim 1, wherein said first and second detector means are further comprised of:

laser triangulation sensors.

3. The method, as in claim 1, wherein said step of measuring a point of release is further comprised of the step of:

determining an average point of release.

4. The method, as in claim 1, wherein said step of measuring said number of wrinkles is further comprised of the steps of:

determining an average web position; and determining a wrinkle when instantaneous web position differs from average web position by a specified value.

5. The method, as in claim 1, wherein said comparing step is further comprised of the steps of:

comparing said average point of release with an operator-settable alarm value; and comparing said total number of wrinkles with said operator-settable alarm value.

* * * * *